US008146415B2

(12) United States Patent
Cartellieri

(10) Patent No.: US 8,146,415 B2
(45) Date of Patent: Apr. 3, 2012

(54) DOWNHOLE GAS CHROMATOGRAPH

(75) Inventor: Ansgar Cartellieri, Lower Saxony (DE)

(73) Assignee: Baker Hughes Incorporated, Houston, TX (US)

( * ) Notice: Subject to any disclaimer, the term of this patent is extended or adjusted under 35 U.S.C. 154(b) by 702 days.

(21) Appl. No.: 12/127,293

(22) Filed: May 27, 2008

(65) Prior Publication Data

US 2009/0294175 A1 Dec. 3, 2009

(51) Int. Cl.
*E21B 47/10* (2006.01)

(52) U.S. Cl. ..... 73/152.18

(58) Field of Classification Search ..... 73/152.18, 73/152.25

See application file for complete search history.

(56) References Cited

U.S. PATENT DOCUMENTS

| | | | | |
|---|---|---|---|---|
| 3,712,111 | A * | 1/1973 | Llewellyn | 73/23.37 |
| 4,412,130 | A | 10/1983 | Winters | |
| 4,492,865 | A | 1/1985 | Murphy et al. | |
| 6,648,083 | B2 | 11/2003 | Evans et al. | |
| 6,768,106 | B2 | 7/2004 | Gzara et al. | |
| 7,281,408 | B2 | 10/2007 | Srinivasan et al. | |
| 7,387,021 | B2 * | 6/2008 | DiFoggio | 73/152.55 |
| 7,600,413 | B2 * | 10/2009 | Shah et al. | 73/23.42 |
| 2005/0205256 | A1 | 9/2005 | DiFoggio | |
| 2006/0016592 | A1 | 1/2006 | Wu | |
| 2006/0210441 | A1 | 9/2006 | Schmidt et al. | |
| 2007/0144740 | A1 | 6/2007 | Guo et al. | |
| 2009/0151426 | A1 * | 6/2009 | Shah et al. | 73/23.35 |

FOREIGN PATENT DOCUMENTS

| | | | |
|---|---|---|---|
| DE | 19726000 | A1 | 11/1998 |
| JP | 61018862 | A * | 1/1986 |
| WO | 9634285 | | 10/1996 |
| WO | 2004065955 | A1 | 8/2004 |

OTHER PUBLICATIONS

Bromboiu, A.O. et al., Application of Semipermeable Membrane Technology in the Measurement of Hydrocarbon Gases in Drilling Fluids, 2000 SPE/AAPG Western Regional Meeting, Jun. 19-23, 2000, pp. 1-12, Society of Petroleum Engineers, Inc.

* cited by examiner

*Primary Examiner* — Hezron E Williams
*Assistant Examiner* — Tamiko D Bellamy
(74) *Attorney, Agent, or Firm* — Cantor Colburn LLP

(57) ABSTRACT

A downhole fluid property estimating apparatus includes an interface in communication with a fluid in a first pressure zone, a collector in communication with the interface, the collector having a second pressure zone, wherein a second pressure zone pressure is less than a first pressure zone pressure, and a gas chromatograph coupled to the collector. A method includes establishing a first pressure zone having a fluid in communication with an interface, establishing a second pressure zone in a collector in communication with the interface, wherein a second pressure zone pressure is less than a first pressure zone pressure, collecting a fluid sample of the fluid in the first pressure zone using the collector, and estimating the downhole fluid property in-situ using a gas chromatograph coupled to the collector.

20 Claims, 2 Drawing Sheets

DOWNHOLE GAS CHROMATOGRAPH

BACKGROUND

1. Technical Field

The present disclosure generally relates to downhole tools and in particular to methods and apparatus for gas chromatography in a downhole environment.

2. Background Information

Information about subterranean formations traversed by the borehole may be obtained by any number of techniques. Techniques used to obtain formation information include obtaining one or more core samples of the subterranean formations and obtaining fluid samples produced from the subterranean formations these samplings are collectively referred to herein as formation sampling. Modern fluid sampling includes various downhole tests and sometimes fluid samples are retrieved for surface laboratory testing.

Typical in-situ fluid testing techniques use indirect measurements from which fluid properties are estimated. For example, spectroscopic testing includes the measurement of electromagnetic energy that is reflected, refracted or attenuated by interaction with the downhole fluid. The resultant energy is then compared to results from known samples, and the downhole fluid property is estimated based on the comparison. These indirect methods do not provide direct in-situ measurement of fluid property and do not provide quantitative results.

SUMMARY

The following presents a general summary of several aspects of the disclosure in order to provide a basic understanding of at least some aspects of the disclosure. This summary is not an extensive overview of the disclosure. It is not intended to identify key or critical elements of the disclosure or to delineate the scope of the claims. The following summary merely presents some concepts of the disclosure in a general form as a prelude to the more detailed description that follows.

Disclosed is an apparatus for estimating a downhole fluid property. The apparatus may include an interface in communication with a fluid in a first pressure zone, a collector in communication with the interface, the collector having a second pressure zone, wherein a second pressure zone pressure is less than a first pressure zone pressure, and a gas chromatograph coupled to the collector.

A method for estimating a downhole fluid property includes establishing a first pressure zone having a fluid in communication with an interface, establishing a second pressure zone in a collector in communication with the interface, wherein a second pressure zone pressure is less than a first pressure zone pressure, collecting a fluid sample of the fluid in the first pressure zone using the collector, and estimating the downhole fluid property in-situ using a gas chromatograph coupled to the collector.

BRIEF DESCRIPTION OF THE DRAWINGS

For a detailed understanding of the present disclosure, reference should be made to the following detailed description of the several non-limiting embodiments, taken in conjunction with the accompanying drawings, in which like elements have been given like numerals and wherein.

DESCRIPTION OF EXEMPLARY EMBODIMENTS

Figure 1:
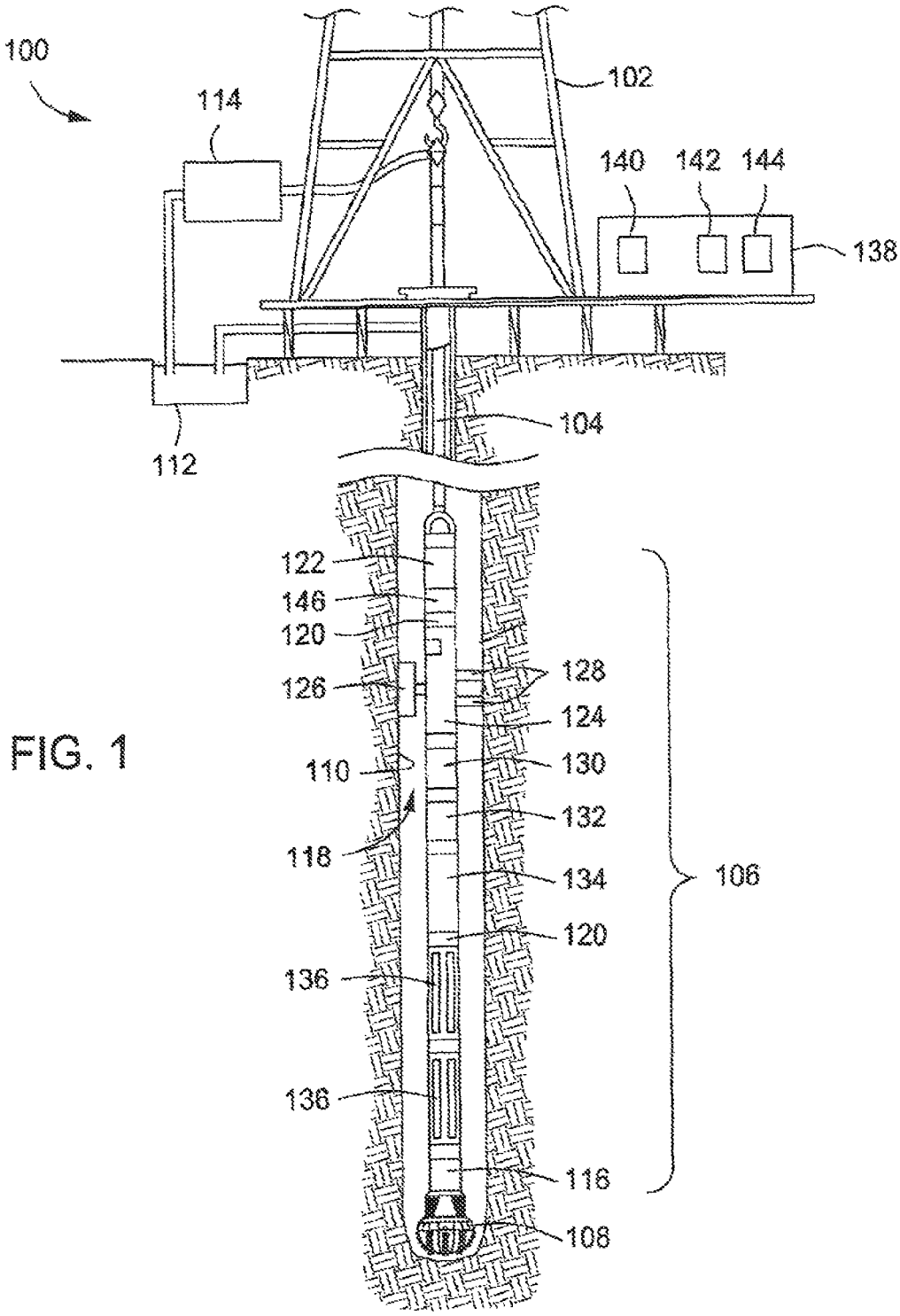
FIG. 1 illustrates a non-limiting example of a drilling system in a measurement-while-drilling ("MWD") arrangement according to several embodiments of the disclosure.

FIG. 1 schematically illustrates a non-limiting example of a drilling system 100 in a measurement-while-drilling ("MWD") arrangement according to several non-limiting embodiments of the disclosure. A derrick 102 supports a drill string 104, which may be a coiled tube or drill pipe. The drill string 104 may carry a bottom hole assembly ("BHA") referred to as a downhole sub 106 and a drill bit 108 at a distal end of the drill string 104 for drilling a borehole 110 through earth formations.

The exemplary drill string 104 operates as a carrier, but any carrier is considered within the scope of the disclosure. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's, drill string inserts, modules, internal housings and substrate portions thereof.

Drilling operations according to several embodiments may include pumping drilling fluid or "mud" from a mud pit 112, and using a circulation system 114, circulating the mud through an inner bore of the drill string 104. The mud exits the drill string 104 at the drill bit 108 and returns to the surface through an annular space between the drill string 104 and inner wall of the borehole 110. The drilling fluid is designed to provide a hydrostatic pressure that is greater than the formation pressure to avoid blowouts. The pressurized drilling fluid may further be used to drive a drilling motor 116 and may be used to provide lubrication to various elements of the drill string 104.

In the non-limiting embodiment of FIG. 1, the downhole sub 106 includes a formation evaluation tool 118. The formation evaluation tool 118 may include an assembly of several tool segments that are joined end-to-end by threaded sleeves or mutual compression unions 120. An assembly of tool segments suitable for the present disclosure may include a power unit 122 that may include one or more of a hydraulic power unit, an electrical power unit and an electro-mechanical power unit. In the example shown, a formation sample tool 124 may be coupled to the formation evaluation tool 118 below the power unit 122.

The exemplary formation sample tool 124 shown comprises an extendable probe 126 that may be opposed by bore wall feet 128. The extendable probe 126, the opposing feet 128, or both may be hydraulically and/or electro-mechanically extendable to firmly engage the well borehole wall. The formation sample tool 124 may be configured for extracting a formation core sample, a formation fluid sample, formation images, nuclear information, electromagnetic information, and/or downhole information, such as pressure, temperature, location, movement, and other information. In several non-limiting embodiments, other formation sample tools not shown may be included in addition to the formation sample tool 124 without departing from the scope of the disclosure.

Continuing now with FIG. 1, several non-limiting embodiments may be configured with the formation sample tool 124 operable as a downhole fluid sampling tool. In these embodiments, a large displacement volume motor/pump unit 130 may be provided below the formation sample tool 124 for line purging. A similar motor/pump unit 132 having a smaller displacement volume may be included in the tool in a suitable location, such as below the large volume pump, for quantitatively monitoring fluid received by the downhole evaluation tool 118 via the formation sample tool 124. As noted above, the formation sample tool 124 may be configured for any number of formation sampling operations. Construction and operational details of a suitable non-limiting fluid sample tool 124 for extracting fluids are more described by U.S. Pat. No. 5,303,775, the specification of which is incorporated herein by reference.

The downhole evaluation tool 118 may include a downhole evaluation system 134 for evaluating several aspects of the downhole sub 106, the drilling system 100, aspects of the downhole fluid in and/or around the downhole sub 106, formation samples received by the downhole sub 106, and of the surrounding formation.

One or more formation sample containers 136 may be included for retaining formation samples received by the downhole sub 106. In several examples, the formation sample containers 136 may be individually or collectively detachable from the downhole evaluation tool 118.

A downhole transceiver 146 may be coupled to the downhole sub 106 for bidirectional communication with a surface transceiver 140. The surface transceiver 140 communicates received information to a controller 138 that includes a memory 142 for storing information and a processor 144 for processing the information. The memory 142 may also have stored thereon programmed instructions that when executed by the processor 144 carry out one or more operations and methods that will become apparent in view of the discussion to follow. The memory 142 and processor 144 may be located downhole on the downhole sub 106 in several non-limiting embodiments.

The system 100 shown in FIG. 1 is only an example of how various tools may be carried into a well borehole using the downhole sub 106. Tools according to the present disclosure may further include direct measurement tools for evaluating fluid characteristics such as content and concentrations. In one or more embodiments, the downhole sub 106 may be used to carry a downhole gas chromatograph for evaluating fluids in-situ. The following discussion and associated figures will present several exemplary downhole gas chromatographs according to the disclosure.

Figure 2:
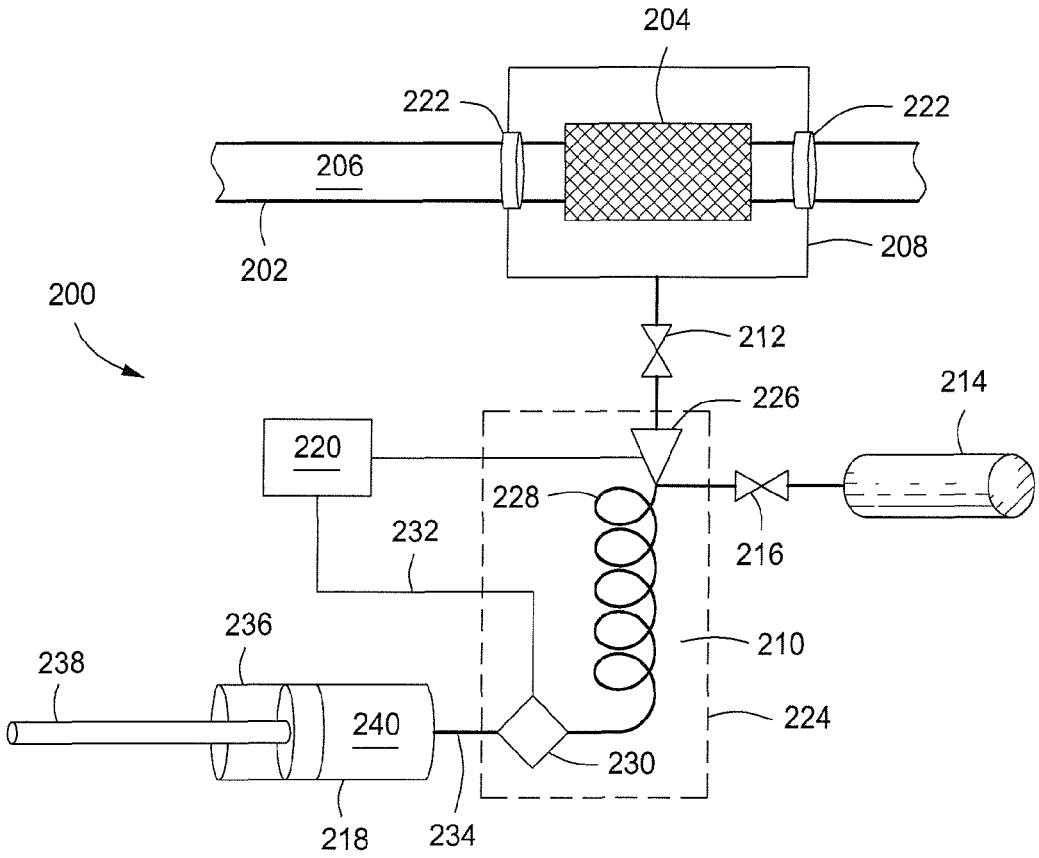
FIG. 2 is a non-limiting example of a downhole fluid test tool that includes a gas chromatograph.

FIG. 2 illustrates a non-limiting example of a downhole fluid test tool 200 that may be incorporated into the downhole sub 106 as part of the downhole evaluation system 134 described above and shown in FIG. 1. As used herein, downhole fluid means any fluid that is carried to, carried in, encountered in, or carried from a downhole environment. A downhole fluid may include drilling fluid, return fluid, formation fluid or any combination thereof. The downhole fluid test tool 200 includes a fluid cell 202. An interface 204 is in communication with fluid 206 in the fluid cell 202, and the interface 204 is also in communication with a collector 208. A gas chromatograph 210 is shown in this example coupled to the collector 208 via a valve 212. The gas chromatograph 210 is coupled to a gas supply 214 via a valve 216. A flow controller 218 is coupled to a distal end of the gas chromatograph 210, and a controller 220 in this example is coupled to the gas chromatograph.

The volume within the fluid cell 202 defines a first pressure zone having an associated pressure and the collector 208 includes a second pressure zone, wherein a second pressure zone pressure is less than a first pressure zone pressure. In one or more embodiments, the first pressure zone pressure may be substantially consistent with the downhole environmental pressure. The downhole environmental pressure, or simply downhole pressure, may range anywhere from a pressure of few hundred bar to several thousands bar. In one or more other embodiments, the pressure in the first pressure zone may be isolated from the downhole pressure and may be substantially lass than the downhole pressure. Any pressure differential between the first pressure zone and the second pressure zone that provides adequate transport of a fluid sample across the interface 204 is within the scope of the disclosure. For example, the pressure differential may be anywhere from about 0.01% to about 99.9% of the first pressure zone pressure.

As an example of the above without limiting the disclosure, the first pressure zone pressure may be much higher than the second pressure zone pressure. For example, the fluid in the fluid cell first zone may be about 2000 bar. In one or more non-limiting embodiments, the second zone pressure may from about 1 bar to about 1999 bar to provide transport from the fluid cell to the collector. In one or more embodiments, additional pressure seals 222 may be included between the collector 208 and the fluid cell 202 to help maintain the pressure differential between the first pressure zone and the second pressure zone. In some embodiments, the pressure seals 222 or additional seals may be positioned between the interface 204 and the fluid cell 202.

The fluid cell 202 may be any useful vessel or conduit for carrying a fluid. For example without limiting the disclosure, the fluid cell may be a flow line within the downhole sub 106, a sample chamber 136, a portion of a sample probe 126 or other fluid-carrying volume within the downhole sub 106. In one or more embodiments, the fluid in the fluid cell 202 may be flowing or the fluid may be stationary. Controlled passage of fluid from the high pressure zone in the fluid cell 202 to the lower pressure zone in the collector 208 is provided at least in part by the interface 204.

The interface 204 may be any suitable interface that allows a fluid sample to pass from the first pressure zone to the second pressure zone. In one or more embodiments, the interface 204 is a sampler that samples a multi-phase portion of the fluid 206 in the fluid cell 202. In one or more embodiments, the interface may include a selective portion that allows only a selected phase of the fluid 206 to pass to the collector 208. In one or more embodiments, the interface 204 may pass a liquid sample from the fluid cell 206 to the collector 208. In one or more embodiments, the interface 204 may pass a gas sample from the fluid cell 206 to the collector 208. A suitable selective portion may include a semi-permeable membrane.

Figure 3:
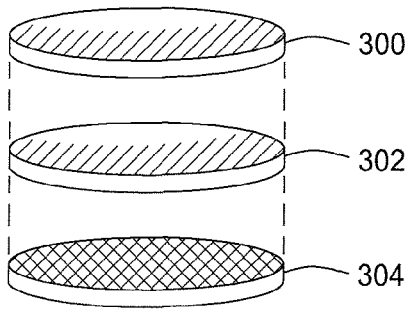
FIG. 3 is an exploded view of a layered semi-permeable membrane.

Referring to FIGS. 2 and 3, in one or more embodiments using a semi-permeable interface, the interface 204 may include a semi-permeable membrane 300. A semi-permeable membrane 300 according to the present disclosure is generally considered to be impermeable to one or more components of the fluid in the fluid cell, while being permeable to other selected components of the fluid in the fluid cell. In one or more embodiments, the semi-permeable membrane may transport selected liquids, selected gases or a combination thereof from the fluid cell to the collector. The membrane 300 may be coupled to a porous support structure 302, and the support structure 302 may be coupled to a porous reinforcement layer 304. The multi-layer structure provides sufficient permeability and can withstand the pressure differential across the interface 204 without adverse deformation.

The semi-permeable membrane 300 may be any suitable semi-permeable material. In several embodiments, the membrane 300 may include a layer of a natural polymer and/or a synthetic polymer. In one embodiment, the membrane may include a layer of silicone rubber. In other embodiments, the interface 204 may include a hard glassy polymer as a membrane 300 material. In several embodiments, the hard glassy polymer may be a high free volume glassy polymer such as polymethylpentene (PMP) that increases sample permeability and selectivity. In another example, a perfluoroalkoxy fluorocarbon resin can be used for high chemical resistance.

The support structure 302 may be any suitable porous support structure. In one example, the support structure is a sintered metal structure. The reinforcement layer 304 may be any suitable layered material that provides sufficient reinforcement for the interface 204, while protecting against pressure-induced deformation. In one example, the reinforcement layer 304 is a metal plate having one or more holes extending through the plate. A face of the plate may include scoring between the holes. The plate may be any suitable, and in one example, the plate is stainless steel. The layered interface 204 according to the example of FIG. 3 need not be planar as shown. In the exemplary embodiment of FIG. 2, the interface is shown as a partial or full cylindrical element disposed about at least a portion of the fluid cell 202 and interfacing with the collector 208.

The collector may be any suitable device that receives a portion of the fluid from the fluid cell. The fluid portion received in the collector may be a liquid, a gas or a combination of liquid and gas. The collector may serve as a holding volume having a reduced pressure with respect to the first pressure zone, and provides the analyte for use in the gas chromatograph 210.

The gas chromatograph 210 in several examples is a miniature device housed on a printed circuit board 224. The gas chromatograph 210 includes an injector 226, a column 228 in fluid communication with the injector 226 and a detector 230 in communication with a distal end of the column 228. In one or more embodiments, glass capillaries may be formed in, mounted on or coupled to the PCB for coupling the injector, column and detector in fluid communication.

The injector 226 may be any suitable injector capable of introducing a fluid sample from the collector 208 to the column 228. The injector may be selected to inject a liquid, a gas or a combination of liquid and gas into the column 228. In one or more embodiments, the injector 226 includes a microelectromechanical systems (MEMS) valve that is in communication with a controller 220 programmed to actuate the injector 226. In one or more embodiments, the injector 226 may include a pneumatic actuator for injecting a fluid sample into the column 228. In one or more embodiments, the injector 226 may include a hydraulic actuator for injecting a fluid sample into the column 228.

Any of several injector types may be used with the several embodiments described herein. In one or more embodiments, the injector 226 may include a split injector, a splitless injector or a combination (S/SL) thereof. The controller 220 may be used to control the S/SL heating element. In one or more embodiments, the injector 226 may include an on-column inlet that is recognized by those skilled in the art as an injector that does not require heat. In one or more embodiments, the injector 226 may include a gas switching valve that allows for an uninterrupted carrier gas stream. In one or more embodiments, the injector 226 may include a purge and trap injector.

A carrier gas source 214 may be coupled to the injector 226. In one or more embodiments, a valve 216 may be included between the carrier gas source 214 and the injector 226. In one or more embodiments, the carrier gas source contains an inert carrier gas. Non-limiting examples of a carrier gas include helium, argon, and nitrogen. The carrier gas operates to carry an analyte to the detector 230 via the column 228. As used herein, analyte means any substance or chemical constituent that is undergoing analysis.

In one or more embodiments, the column 228 may be any suitable conduit for gas chromatography. In one or more embodiments, the column may be packed or capillary. The column 228 may be any flow-through narrow channel or tube-like passage that allows a sample to pass with the carrier gas. In one or more embodiments, the column passage includes a stationary phase filling or coating that impedes the analyte depending on the analyte chemical properties. The stationary phase in the column separates different components of the analyte, and the separated components exit the column 228 sequentially based on a retention time. The retention time may be further controlled by controlling the carrier gas flow rate, and the temperature. An output end of the column 228 is coupled to the detector 230.

The detector 230 may be any suitable detector for estimating characteristics of the separated components exiting the column 228. In one or more embodiments the detector may include a flame ionization detector, a mass spectrometer, a heat conductivity detector or any combination thereof. In one or more embodiments, the detector 230 includes an electrical signal output 232 coupled to the controller 220. In one or more embodiments, the detector 230 includes a fluid output 234 in communication with the flow control device 218.

The flow control device 218 may include any suitable device for controlling fluid flow through the gas chromatograph 210. In one or more embodiments, the flow control device 218 includes a housing 236 and an internal piston 238 that is operable to control pressure within a housing cavity 240. Pressure within the cavity 240 may be controlled by the piston 238 in order to flow fluid through the gas chromatograph 210. In one or more embodiments, the pressure at the injector 226 is about 1 bar and the flow control device 218 is operable to reduce pressure within the cavity 240 to less than 1 bar. In one or more embodiments, the flow control device may include a vessel or bottle that is initially evacuated to a pressure less than the pressure at the injector 226. A valve not shown in this example may be used to open the vessel to allow flow through the gas chromatograph. Those skilled in the art with the benefit of the present disclosure will recognize that other flow control devices may be used without departing from the scope of the invention. For example and without limitation, the flow control device may include an electromechanical pump, a hydraulic pump, a pneumatic pump or any combination thereof. In one or more embodiments, the flow control device 218 may be a micro-pump disposed on a printed circuit board 224 along with the gas chromatograph 210 or on a separate printed circuit board.

In view of the several embodiments of a downhole fluid test apparatus described above and shown in FIGS. 1-3, those skilled in the art will appreciate several operational embodiments to follow. Reference will be made to components shown in FIGS. 1-3, however methods disclosed herein may be practiced using alternative device and/or systems without departing from the scope of the disclosure. A downhole sub 106 may be may be conveyed in a well borehole 110 using any suitable carrier. A downhole fluid is carried in a fluid cell 202 where the pressure in the fluid cell is at about downhole pressure. In one or more embodiments, the pressure in the fluid cell 202 may be as much as 2000 bar or more. In one or more embodiments, the first pressure zone pressure may be less than the downhole pressure as in the case where the fluid is retrieved into the tool and the pressure in the fluid cell is reduced.

Fluid pressure in the fluid cell 202 establishes a first pressure zone in communication with an interface 204. As noted above, the interface 202 may be a selective interface to allow only a portion of the fluid 206 to pass to a collector 208 via the interface. In one or more embodiments, a semi-permeable membrane forms at least a portion of the interface 204, and a gas component, a liquid component or a combination of gas and liquid components of the fluid 206 may be passed to the collector 208 via the semi-permeable membrane.

The interface 204 is in communication with the collector 208 and the pressure within the collector 208 establishes a second pressure zone. In one or more embodiments, the pressure within the second pressure zone is less than the pressure in the first pressure zone. In one or more embodiments, the second pressure zone pressure is in an inclusive range of about 0.01% to about 99.9% of the pressure in the first pressure zone. In one or more embodiments, the second pressure zone pressure is about 1 bar.

The fluid sample, which may be a gas, a liquid or a combination thereof, may be tested by passing at least a portion of the fluid sample to a downhole gas chromatograph 210. In one or more embodiments, a valve 212 may be used to control fluid sample flow toward the gas chromatograph. A sample analyte is injected into a column gas stream provided by a downhole gas supply 214. Fluid flow through the column may be facilitated using the flow control device 218, which may be used to reduce pressure at the output of the gas chromatograph 210.

The analyte flows through the column 228 and is controllably impeded due to the column stationary phase material. The column output comprises a separated analyte that is then tested using the detector 230. The detector generates an output signal that is conveyed to the controller 220, which is used to estimate the properties of the downhole fluid. In one or more embodiments, the output signal may be a digital signal, an analog signal or a combination of digital and analog signals. The controller 220, which includes a processor and instructions stored in a memory, receives the output signals and estimates the fluid property using the programmed instructions. The fluid property estimated may include fluid content and quantity of the fluid contents. The estimates may be stored in the downhole memory for later retrieval. In one or more embodiments, selected portions of the estimates may be transmitted in substantially real time to a surface controller 138 for further processing and/or output. Surface operators may use the real-time estimates for determining a course of action in a drilling operation or for determining production parameters or for other actions.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Such insubstantial variations are to be considered within the scope of the claims below.

What is claimed is:

1. An apparatus for estimating a downhole fluid property comprising:

an interface in communication with a fluid in a first pressure zone;

a collector in communication with the interface, the collector having a second pressure zone, wherein a second pressure zone pressure is less than a first pressure zone pressure;

a gas chromatograph coupled to the collector; and a flow controller coupled to the gas chromatograph and configured to control an output pressure of the gas chromatograph; and a pressure-controlled cavity in fluid communication with a fluid output of the gas chromatograph, the cavity having an internal pressure configured to be controlled by the flow controller.

2. An apparatus according to claim 1, wherein the interface comprises a fluid-selective member that is permeable to one or more components of the fluid in the first pressure zone.

3. An apparatus according to claim 1, wherein the interface comprises a semi-permeable membrane.

4. An apparatus according to claim 1 further comprising a fluid cell that carries the fluid in the first pressure zone.

5. An apparatus according to claim 4, wherein the fluid cell includes at least one of a fluid line, a fluid sample chamber, and a volume within a fluid sampling probe.

6. An apparatus according to claim 1, wherein the fluid includes at least one of formation fluid, drilling fluid and return fluid.

7. An apparatus according to claim 1, wherein the second pressure zone has a pressure of about 0.01% to about 99.9% of the pressure in the first pressure zone.

8. An apparatus according to claim 1, wherein the gas chromatograph includes an injector, a column and a detector.

9. An apparatus according to claim 8, wherein the injector, column and detector are disposed on one or more circuit boards.

10. An apparatus according to claim 8, wherein the injector, the column, or both comprise one or more MEMS devices.

11. An apparatus according to claim 8, wherein the column comprises a plurality of columns, each column being associated with a corresponding detector.

12. An apparatus according to claim 1, wherein the flow controller includes a piston moveable within the cavity to control the internal pressure.

13. An apparatus according to claim 12, wherein the flow controller includes at least one of a piston moveable within a housing and an evacuated vessel to reduce an output pressure of the gas chromatograph to a pressure less than the second pressure zone pressure.

14. A method for estimating a downhole fluid property comprising:

establishing a first pressure zone having a fluid in communication with an interface;

establishing a second pressure zone in a collector in communication with the interface, wherein a second pressure zone pressure is less than a first pressure zone pressure;

collecting a fluid sample of the fluid in the first pressure zone using the collector;

estimating the downhole fluid property in-situ using a gas chromatograph coupled to the collector; and controlling an output pressure of the gas chromatograph via a flow controller coupled to the gas chromatograph; and directing output gas from the gas chromatograph to a pressure-controlled cavity in fluid communication with a fluid output of the gas chromatograph, the cavity having an internal pressure configured to be controlled by the flow controller.

15. A method according to claim 14, wherein the first pressure zone and second pressure zone are established at least in part using an interface disposed between the first pressure zone and second pressure zone.

16. A method according to claim 15, wherein the interface comprises a fluid-selective member that is permeable to one or more components of the fluid in the first pressure zone.

17. A method according to claim 15, wherein the interface comprises a semi-permeable membrane and wherein collecting a fluid sample of the fluid in the first pressure zone includes collecting a gas component, a liquid component, or a combination of a gas component and a liquid component of the fluid.

18. A method according to claim 14 further comprising flowing at least a portion of the fluid sample through a gas chromatograph that includes an injector, a column and a detector.

19. A method according to claim 18, wherein the fluid sample is combined with a carrier gas stream.

20. A method according to claim 18, wherein controlling the output pressure includes reducing the output pressure of the gas chromatograph to a pressure less than the second pressure zone pressure.

* * * * *